US011166090B2

(12) United States Patent
Alexander

(10) Patent No.: US 11,166,090 B2
(45) Date of Patent: Nov. 2, 2021

(54) LOUDSPEAKER DESIGN

(71) Applicant: Eric Jay Alexander, Orem, UT (US)

(72) Inventor: Eric Jay Alexander, Orem, UT (US)

( * ) Notice: Subject to any disclaimer, the term of this patent is extended or adjusted under 35 U.S.C. 154(b) by 0 days.

(21) Appl. No.: 16/503,332

(22) Filed: Jul. 3, 2019

(65) Prior Publication Data

US 2020/0014993 A1 Jan. 9, 2020

Related U.S. Application Data

(60) Provisional application No. 62/694,818, filed on Jul. 6, 2018.

(51) Int. Cl.

| | |
|---|---|
| ***H04R 1/02*** | (2006.01) |
| ***H04R 1/24*** | (2006.01) |
| ***H04R 9/06*** | (2006.01) |
| ***H04R 1/26*** | (2006.01) |
| ***H04R 1/40*** | (2006.01) |
| ***H04R 1/34*** | (2006.01) |

(52) U.S. Cl.

CPC ..... *H04R 1/025* (2013.01); *H04R 1/24* (2013.01); *H04R 1/26* (2013.01); *H04R 1/345* (2013.01); *H04R 1/403* (2013.01); *H04R 9/063* (2013.01); *H04R 2201/403* (2013.01)

(58) Field of Classification Search

CPC . H04R 1/025; H04R 1/24; H04R 1/26; H04R 1/403; H04R 9/063; H04R 1/345; H04R 2201/403; H04R 2201/401; H04R 1/02

See application file for complete search history.

(56) References Cited

U.S. PATENT DOCUMENTS 4,031,318 A * 6/1977 Pitre ..... H04R 1/20 381/386
7,409,071 B1 * 8/2008 Bromer ..... H04R 1/403 381/186

(Continued)

FOREIGN PATENT DOCUMENTS

JP 60109995 A * 5/1985 ..... H04R 1/403
JP 60109995 A * 6/1985 ..... H04R 1/403

*Primary Examiner* — Oyesola C Ojo

(74) *Attorney, Agent, or Firm* — Kirton McConkie; Adam D. Stevens

(57) ABSTRACT

A loudspeaker in which a plurality of speaker drivers is jointly tasked with reproducing sounds. The plurality of speaker drivers is arranged on the loudspeaker so as to achieve a desired sound effect at a listening position. The plurality of speaker drivers is arranged in an arcuate arrangement or in a sinusoidal arrangement. The desired sound effect may be facilitated or enhanced by modifying the timing of sounds emanated from each of the plurality of speaker drivers. Alternatively, sounds may be sent to each of the plurality of speaker drivers substantially simultaneously. The sound effect achieved may be a time-alignment effect such that the sound arriving at the listening position is time-aligned to maximize constructive interference between the various speaker drivers of the plurality of speaker drivers. Alternatively, the sound effect achieved by other implementations may be a progressive kick in sound waves moving along the arcuate or sinusoidal arrangement.

20 Claims, 8 Drawing Sheets

(56) References Cited

U.S. PATENT DOCUMENTS

| | | | | |
|---|---|---|---|---|
| 7,606,383 | B2 * | 10/2009 | Engebretson | H04R 5/02 381/335 |
| 8,170,223 | B2 * | 5/2012 | Keele, Jr. | H04R 1/403 381/59 |
| 8,189,822 | B2 * | 5/2012 | Jakowski | H04R 1/403 381/182 |
| 8,428,293 | B2 * | 4/2013 | Fujise | H04R 1/403 381/398 |
| 8,675,899 | B2 * | 3/2014 | Jung | H04R 1/403 381/307 |
| 9,137,618 | B1 * | 9/2015 | Waller, Jr. | G10H 1/0091 |
| 10,327,051 | B2 * | 6/2019 | Kutil | H04R 1/403 |
| 10,479,235 | B1 * | 11/2019 | Stroud | B60N 2/976 |
| 2004/0218773 | A1 * | 11/2004 | Andrews | H04R 1/403 381/335 |
| 2013/0034251 | A1 * | 2/2013 | Fincham | H03G 3/007 381/160 |
| 2014/0353074 | A1 * | 12/2014 | Bridge | H04R 1/026 181/145 |
| 2015/0172795 | A1 * | 6/2015 | Roberts | H04R 1/345 381/98 |
| 2015/0382108 | A1 * | 12/2015 | Takumai | H04R 5/04 381/307 |
| 2017/0251296 | A1 * | 8/2017 | Smithers | H04R 1/403 |
| 2018/0376240 | A1 * | 12/2018 | Brousseau | H04R 27/00 |

* cited by examiner

LOUDSPEAKER DESIGN

CROSS-REFERENCE TO RELATED APPLICATIONS

This application claims the benefit of U.S. Provisional Application No. 62/694,818, filed Jul. 6, 2018.

BACKGROUND OF THE INVENTION

1. Field of the Invention

The present invention relates to loudspeaker design, and more particularly to the use of curved arrays of speaker drivers in loudspeaker designs to achieve desired audio effects at a listening position.

2. Background and Related Art

Loudspeakers typically employ one or more sound transducers ("speaker drivers"), which are adapted to transduce an electrical signal into an audio signal. The transducers used in loudspeakers may include one or more sub-woofers reproducing extremely low frequencies, one or more woofers reproducing low frequencies, one or more mid-range drivers reproducing mid-range frequencies, one or more tweeters producing high-range frequencies, and/or one or more super-tweeters producing extremely high frequencies. The choice of and placement of drivers in loudspeakers affects the quality of sound arriving at a typical listening position, as does the choice of other associated audio equipment, including cross-over circuitry feeding electrical signals to each of the selected speaker drivers.

Different speaker drivers have different fundamental characteristics, including fundamental frequencies, moving masses, sound dispersion characteristics, and the like. Loudspeaker designers take into account the various characteristics when attempting to design loudspeakers for various purposes. Regardless, typical goals of high-end loudspeaker design may include to design loudspeakers having high fidelity, to design loudspeakers having high efficiency, to design loudspeakers having a certain characteristic tone, and the like. U.S. Pat. No. 9,247,339, issued Jan. 26, 2016, which is incorporated herein by reference for all it discloses, discusses certain considerations that may be considered in loudspeaker design.

Speaker drivers have varying levels of directivity. Speaker directivity is a result of the constructive and destructive interference between sound waves originating from different locations of a single speaker driver, or sometimes between sound waves originating from different speaker drivers. The on-axis response and the off-axis response of a speaker driver may be significantly different, again especially at higher frequencies. Loudspeaker designers must account for the effects of directivity when designing their loudspeakers, otherwise, the listening experience may be negatively affected.

BRIEF SUMMARY OF THE INVENTION

Implementation of the invention provides a novel loudspeaker in which a plurality of speaker drivers is jointly tasked with reproducing sounds. In certain implementations, the plurality of speaker drivers is tasked with jointly reproducing sounds in a frequency spectrum that is generally lower than such speaker drivers would typically be used in traditional loudspeaker design. See, for example, the considerations discussed in U.S. Pat. No. 9,247,339, incorporated herein. Thus, for example, a plurality of tweeters may be tasked with reproducing sounds that might traditionally be expected to be reproduced by a mid-range speaker driver or woofer speaker driver. As another example, a plurality of mid-range speaker drivers may be tasked with reproducing sounds that might traditionally be expected to be reproduced by a woofer or sub-woofer.

Regardless of the frequency range sent to the plurality of speaker drivers, the plurality of speaker drivers is arranged on the loudspeaker in a novel way so as to achieve a desired sound effect at a listening position. In particular implementations, the plurality of speaker drivers is arranged in an arcuate arrangement. In other implementations, the plurality of speaker drivers is arranged in a sinusoidal arrangement. In some implementations, the desired sound effect may be facilitated or enhanced by modifying the timing of sounds emanated from each of the plurality of speaker drivers. In other implementations, sounds may be sent to each of the plurality of speaker drivers substantially simultaneously.

The sound effect achieved by various implementations may be a time-alignment effect such that the sound arriving at the listening position is time-aligned to maximize constructive interference between the various speaker drivers of the plurality of speaker drivers. Alternatively, the sound effect achieved by other implementations may be a progressive kick in sound waves moving along the arcuate or sinusoidal arrangement, such that sounds from adjacent speaker drivers in the arcuate or sinusoidal arrangement arrive at the listening position with a slight delay to provide the impression of the progressive kick in sound waves at the listening position.

Certain implementations are provided in traditional loudspeakers intended for use in a room or other large environment. Other implementations are provided in a near-field monitor, in which the listening position is comparatively close to the loudspeaker containing the plurality of speaker drivers. In some implementations, the near-field monitor is incorporated into a dedicated listening environment, which may include a dedicated seat for listening to sound through the loudspeaker. In some such implementations, if the seat permits reclining movement or other movement that could adjust or modify the listening position, the dedicated listening environment may include a mechanism that maintains a relative position between the near-field loudspeaker and the listening position, such that the near-field loudspeaker moves with the seat and/or listening position. For example, if the seat of the listening environment is capable of reclining, the near-field loudspeaker may be capable of concurrently elevating, tilting, and/or moving forward to maintain position relative to the listening position provided by the reclining seat.

Implementations of the invention provide loudspeakers incorporating arcuate and/or sinusoidal patterns of a plurality of substantially similar speaker drivers to achieve a desired resulting sound at a listening position. According to an implementation of the invention, a loudspeaker includes a first plurality of substantially similar speaker drivers disposed on a front panel of a speaker cabinet, the first plurality of substantially similar speaker drivers being disposed in an arcuate arrangement adapted to modify time alignment of a sound signal produced by each of the first plurality of substantially similar speaker drivers at a listening position.

The front panel of the speaker cabinet may be substantially planar, and the first plurality of substantially similar speaker drivers may be mounted in a single plane substantially parallel to a plane of the front panel of the speaker cabinet. Alternatively, the depth of placement may vary from speaker driver to speaker driver among the plurality of speaker drivers to further modify time alignment of a sound signal produced by each of the first plurality of substantially similar speaker drivers at the listening position.

The first plurality of substantially similar speaker drivers may each have a driver axis, and the driver axis of each of the first plurality of substantially similar speaker drivers may be substantially perpendicular to the plane of the front panel of the speaker cabinet. Alternatively, each of the first plurality of substantially similar speaker drivers may have a driver axis, and the driver axis of each of the first plurality of substantially similar speaker drivers may be within approximately 10° of perpendicular to the plane of the front panel of the speaker cabinet.

A travel path distance between each of the first plurality of substantially similar speaker drivers and the listening position may be substantially identical to a travel path distance of all the other speaker drivers of the first plurality of substantially similar speaker drivers. The arcuate arrangement may place a central speaker driver of the first plurality of substantially similar speaker drivers most proximate to a first lateral side of the front panel, with each successive speaker driver of the remaining speaker drivers of the first plurality of substantially similar speaker drivers being disposed farther from the first lateral side of the front panel and closer to a second lateral side of the front panel.

The loudspeaker may further include a second plurality of the substantially similar speaker drivers also arranged in an arcuate arrangement. The arcuate arrangement of the second plurality of the substantially similar speaker drivers may place a central speaker driver of the second plurality of the substantially similar speaker drivers equally proximate to the first lateral side of the front panel as the central speaker driver of the first plurality of substantially similar speaker drivers, with each successive speaker driver of the remaining speaker drivers of the second plurality of substantially similar speaker drivers being disposed farther from the first lateral side of the front panel and closer to a second lateral side of the front panel. The first plurality and the second plurality of the substantially similar speaker drivers together may form a part of a sinusoidal array of the substantially similar speaker drivers.

The time alignment of the sound signal at the listening position may include an interval gap selected to provide an ongoing kick in acoustic sound as the sound is received at the listening position. The first plurality of substantially similar speaker drivers may be driven by a plurality of individual amplifiers with incorporated time delays to provide the ongoing kick in acoustic sound at the listening position.

The time alignment of the sound signal produced by each of the first plurality of substantially similar speaker drivers may be a substantially simultaneous time alignment.

The loudspeaker may further include one or more additional speaker drivers having a larger size and deeper cone. The additional one or more additional speaker drivers may be disposed on the front panel within an ellipse defined by the arcuate arrangement of the first plurality of substantially similar speaker drivers such that a travel path between each of the first plurality of substantially similar speaker drivers to the listening position and a travel path of the one or more additional speaker drivers to the listening position is substantially equal.

The speaker drivers of the first plurality of substantially similar speaker drivers may be tweeters, super tweeters, or midrange drivers. The loudspeaker may also include an additional speaker driver such as a midrange driver, a midbass driver, a bass driver, a woofer, or a subwoofer.

The loudspeaker may be a near-field monitor, wherein the first plurality of the substantially similar speaker drivers is disposed along the arcuate arrangement at a right side of the near-field monitor, and wherein a second plurality of the substantially similar speaker drivers is disposed in an arcuate arrangement at a left side of the near-field monitor. The near-field monitor may further include additional speaker drivers on either side of the near-field monitor.

The first plurality of substantially similar speaker drivers may be configured to transmit audio signals of a lower frequency range than a single instance of the substantially similar speaker driver would normally be tasked to reproduce according to traditional loudspeaker design.

Implementations of the invention provide a sound transducing device adapted to receive an electronic signal and to transduce the electronic signal into an audible sound signal. The sound transducing device includes a front panel, a first plurality of substantially similar sound transducers arranged in an arcuate arrangement proximate a first side of the front panel, and a second plurality of the substantially similar sound transducers arranged in a mirrored arcuate arrangement proximate an opposite side of the front panel. The sound transducing device may be incorporated into a movable seating device having a listening position corresponding to a head of a user of the seating device, wherein the sound transducing device is incorporated into the seating device in a manner that ensures that the sound transducing device maintains a fixed relative position and orientation with respect to the listening position.

BRIEF DESCRIPTION OF THE SEVERAL VIEWS OF THE DRAWINGS

The objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described and explained with additional specificity and detail through the use of the accompanying drawings in which:

DETAILED DESCRIPTION OF THE INVENTION

Figure 1:
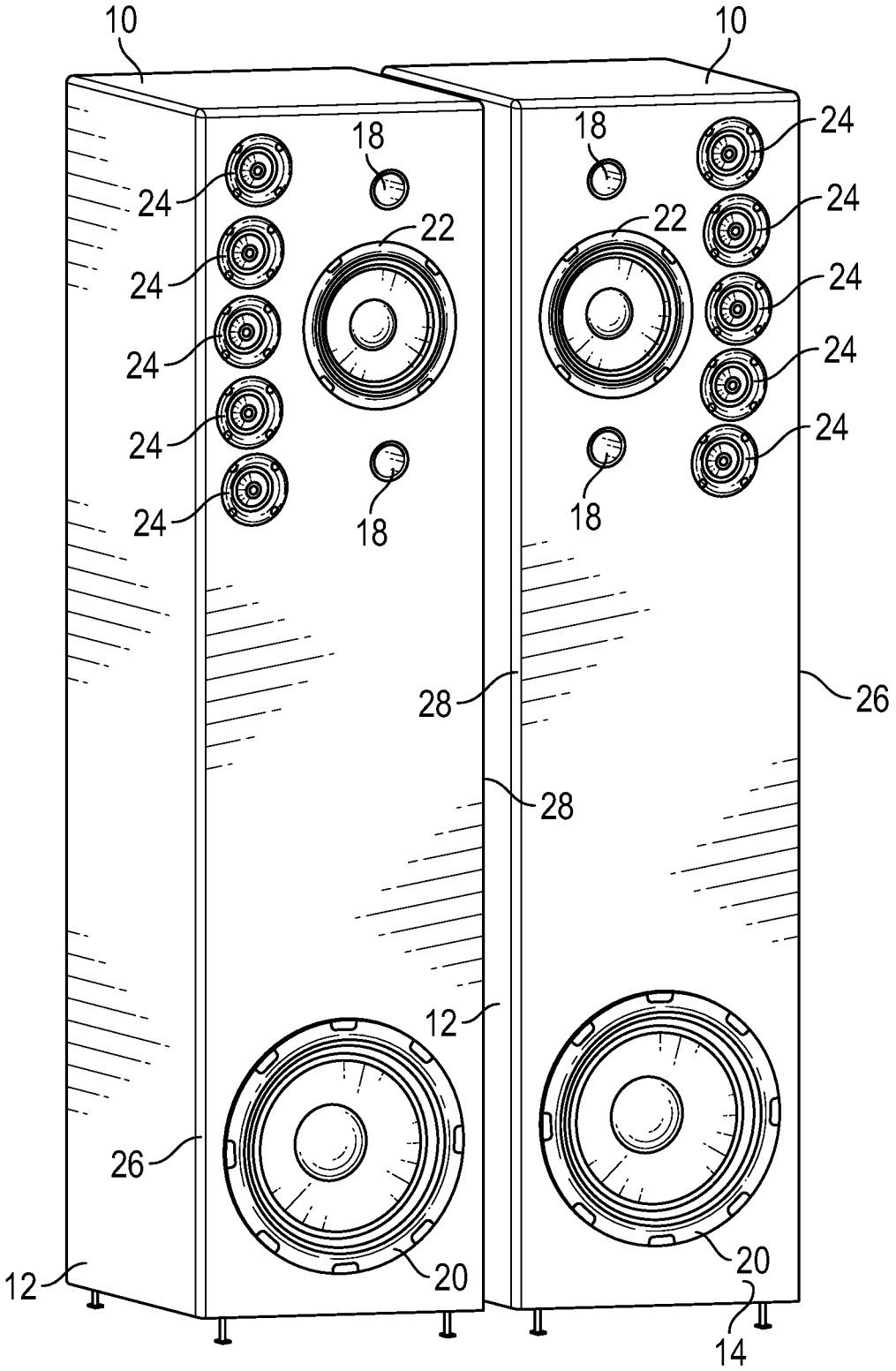
FIG. 1 shows a perspective view of a pair of loudspeakers in accordance with embodiments of the invention.

A description of embodiments of the present invention will now be given with reference to the Figures. It is expected that the present invention may take many other forms and shapes, hence the following disclosure is intended to be illustrative and not limiting, and the scope of the invention should be determined by reference to the appended claims.

In the specification and in the claims, the terms "substantially identical" or "substantially similar" taken with reference to sound transducers or speaker drivers is intended to refer to and indicate that the sound transducers or speaker drivers are all of a same type, size, and characteristics, within the range of normal manufacturing tolerances. In other words, the sound transducers or speaker drivers that are "substantially identical" or "substantially similar" are typically of the same type and manufacturer, but may potentially be of a different manufacturer if they have or are generally recognized as having corresponding sound transducing characteristics such as fundamental frequencies, frequency responses, efficiencies, and the like, again within traditional acceptable manufacturing tolerances. Such speaker drivers or sound transducers may be of any applicable frequency range, as long as they are of a same type, size, and have substantially similar characteristics. Such speaker drivers or sound transducers may include high-frequency drivers/transducers such as super tweeters and tweeters, mid-range drivers/transducers, and low-frequency drivers/transducers such as woofers or subwoofers. Speaker drivers or sound transducers may be of any desired size and characteristic in embodiments of the invention, including full-spectrum drivers/transducers.

In the specification and in the claims, speaker drivers may be referred to as having a "driver axis." This term is intended to refer to the concept of speaker directivity and refers to a line generally extending directly outward from the speaker driver, along which line a speaker driver generally has a minimum of phase cancellation effects from sound emanating from different locations of the speaker driver. For a typical generally circular speaker driver, the driver axis intersects the center of the circular speaker driver and extends generally perpendicular to a plane containing the outer rim of the speaker driver.

Speaker drivers may be of varying types having varying characteristics. Speaker drivers, taken alone, typically have a range of frequencies over which they are deemed capable of generally accurately reproducing sounds (their reproduction frequency response), though in practice, it is typical in loudspeaker design for individual speaker drivers to be tasked with reproducing sounds within a subset of the frequencies they are capable of producing, using crossover networks or other components to limit the range of frequencies sent to each speaker driver. As set forth in U.S. Pat. No. 9,247,339, incorporated herein by reference, in some loudspeaker designs, speaker drivers can be tasked with reproducing frequencies of sounds that might traditionally be considered as falling below the range of ideal frequencies for that particular type of speaker driver (as the speaker driver would not be expected to move sufficient air mass), with multiple speaker drivers being used to move sufficient air mass to achieve desired sound levels at the lower frequencies, but using a lower moving speaker mass overall.

In general, speaker drivers commonly known as super tweeters are generally intended to reproduce the highest range of frequencies, including, at times, ranges of frequencies deemed to be higher than can be identified by human hearing, and are generally referred to as having a reproduction frequency response of above about 4 kHz (e.g. of 4 kHz to 35 kHz, of 10 kHz to 50 kHz, of 20 kHz to 100 kHz, and the like). Speaker drivers commonly known as tweeters are generally intended to reproduce high-frequency sound, including sounds in the upper range of human hearing, such as having a reproduction frequency response in the range of about 2 kHz to about 20 kHz, though particular tweeters may have reproduction frequency responses in ranges extending from lower frequencies above or below about 2 kHz to higher frequencies above or below about 20 kHz.

Speaker drivers commonly known as midrange drivers are generally intended to reproduce a middle range of frequencies, and are generally referred to as having a reproduction frequency response of about 250 Hz to about 2 kHz or of about 1 kHz to about 6 kHz, depending on the application. As with tweeters, particular midrange speaker drivers may have reproduction frequency responses having a lower frequency above or below 250 Hz or 1 kHz, and an upper frequency above or below 2 kHz or 6 kHz.

Speaker drivers commonly known as woofers are generally intended to reproduce a low range of frequencies, and are generally referred to as having a reproduction frequency range of about 40 Hz to about 500 Hz, though particular woofers may have reproduction frequency responses having a lower frequency above or below 40 Hz and an upper frequency above or below 500 Hz. Mid-bass drivers may have a reproduction frequency response falling between and/or overlapping an upper range of frequencies of a woofer and a lower range of frequencies of a mid-range driver. Some loudspeakers may include one or more speaker drivers, known as subwoofers, intended to reproduce the lowest range of frequencies, such as between 20 Hz to 200 Hz, 20 Hz to 100 Hz, or 20 Hz to 80 Hz, depending on the system or application. Some speaker drivers, known as full-range drivers, are intended to reproduce as much of the audible frequency range as possible and may be used in some instances, but are not typically used in high-end loudspeaker design due to limitations in reproducing full-spectrum audio sound.

In particular loudspeaker designs, the range of frequencies sent to the individual speaker drivers may be less than the full range of frequencies which each particular speaker driver is capable of reproducing, so as to maximize the overall fidelity of the loudspeaker system. The ranges of frequencies sent to each speaker driver may be controlled using audio electronic components, such as crossover networks, individual amplifiers, and the like.

Individual loudspeaker designs may include various speaker drivers, and the specific design may impact the manner in which certain speaker drivers of the design are referred to. For example, in a two-way speaker (a loudspeaker having two speaker drivers), a speaker driver might be referred to as a woofer, while that same speaker driver might be referred to as a mid-range speaker driver in a design having more speaker drivers. Accordingly, the terminology used with respect to individual drivers of a multi-driver loudspeaker design is most typically used in reference to the other drivers of the design.

Embodiments of the invention provide a plurality of essentially any type of speaker driver arranged in an arcuate arrangement as part of a loudspeaker. In many embodiments, the plurality of speaker drivers includes speaker drivers intended for higher-frequency reproduction than other speaker drivers of the loudspeaker, but this is not strictly necessary for all embodiments. Accordingly, the plurality of speaker drivers in the arcuate arrangement may be tweeters, mid-range drivers, woofers, or the like, and may transduce any desired range of frequencies to achieve the desired sound effect at the listening position. In some embodiments, the plurality of speaker drivers are collectively tasked with reproducing a frequency range of sounds lower than speaker drivers of that type would traditionally be expected to reproduce in traditional loudspeaker design, as discussed in U.S. Pat. No. 9,247,339, such that the collective moving mass of the plurality of speaker drivers is less than an equivalent moving mass of a single larger speaker driver. Regardless, exemplary embodiments will be described in more detail in which the plurality of speaker drivers arranged in the arcuate arrangement are tweeters.

Embodiments of the invention provide a novel loudspeaker in which a plurality of speaker drivers is jointly tasked with reproducing sounds. In certain embodiments, the plurality of speaker drivers is tasked with jointly reproducing sounds in a frequency spectrum that is generally lower than such speaker drivers would typically be used in traditional loudspeaker design. See, for example, the considerations discussed in U.S. Pat. No. 9,247,339, incorporated herein by reference. Thus, for example, a plurality of tweeters may be tasked with reproducing sounds that might traditionally be expected to be reproduced by a mid-range speaker driver or woofer speaker driver. As another example, a plurality of mid-range speaker drivers may be tasked with reproducing sounds that might traditionally be expected to be reproduced by a woofer or sub-woofer.

Regardless of the frequency range sent to the plurality of speaker drivers, the plurality of speaker drivers is arranged on the loudspeaker in a novel way so as to achieve a desired sound effect at a listening position. In particular embodiments, the plurality of speaker drivers is arranged in an arcuate arrangement. In other embodiments, the plurality of speaker drivers is arranged in a sinusoidal arrangement. In some embodiments, the desired sound effect is facilitated or enhanced by modifying the timing of sounds emanated from each of the plurality of speaker drivers. In other embodiments, sounds are sent to each of the plurality of speaker drivers substantially simultaneously.

The sound effect achieved by various embodiments is a time-alignment effect such that the sound arriving at the listening position is time-aligned to maximize constructive interference between the various speaker drivers of the plurality of speaker drivers. Alternatively, the sound effect achieved by other embodiments is a progressive kick in sound waves moving along the arcuate or sinusoidal arrangement, such that sounds from adjacent speaker drivers in the arcuate or sinusoidal arrangement arrive at the listening position with a slight delay to provide the impression of the progressive kick in sound waves at the listening position.

Certain embodiments are provided in traditional loudspeakers (e.g., stereo loudspeakers) intended for use in a room or other large environment. Other embodiments are provided in a near-field monitor, in which the listening position is comparatively close to the loudspeaker containing the plurality of speaker drivers. In some embodiments, the near-field monitor is incorporated into a dedicated listening environment, which may include, for example, a dedicated seat for listening to sound through the loudspeaker. In some such embodiments, if the seat permits reclining movement or other movement that could adjust or modify the listening position, the dedicated listening environment may include a mechanism that maintains a relative position between the near-field loudspeaker and the listening position, such that the near-field loudspeaker moves with the seat and/or listening position. For example, in some embodiments, if the seat of the listening environment is capable of reclining, the near-field loudspeaker is also capable of concurrently elevating, tilting, and/or moving forward to maintain position relative to the listening position provided by the reclining seat.

Embodiments of the invention provide loudspeakers incorporating arcuate and/or sinusoidal patterns of a plurality of substantially similar speaker drivers to achieve a desired resulting sound at a listening position. According to embodiments of the invention, a loudspeaker includes a first plurality of substantially similar speaker drivers disposed on a front panel of a speaker cabinet, the first plurality of substantially similar speaker drivers being disposed in an arcuate arrangement adapted to modify time alignment of a sound signal produced by each of the first plurality of substantially similar speaker drivers at a listening position.

The front panel of the speaker cabinet in some embodiments is substantially planar, and the first plurality of substantially similar speaker drivers in some embodiments is mounted in a single plane substantially parallel to a plane of the front panel of the speaker cabinet. Alternatively, the depth of placement varies from speaker driver to speaker driver among the plurality of speaker drivers to further modify time alignment of a sound signal produced by each of the first plurality of substantially similar speaker drivers at the listening position.

The first plurality of substantially similar speaker drivers typically each has a driver axis, and the driver axis of each of the first plurality of substantially similar speaker drivers in some embodiments is substantially perpendicular to the plane of the front panel of the speaker cabinet. Alternatively, each of the first plurality of substantially similar speaker drivers has a driver axis, and the driver axis of each of the first plurality of substantially similar speaker drivers in some embodiments is within approximately 10° of perpendicular to the plane of the front panel of the speaker cabinet.

A travel path distance between each of the first plurality of substantially similar speaker drivers and the listening position in some embodiments is substantially identical to a travel path distance of all the other speaker drivers of the first plurality of substantially similar speaker drivers. The arcuate arrangement in some embodiments places a central speaker driver of the first plurality of substantially similar speaker drivers most proximate to a first lateral side of the front panel, with each successive speaker driver of the remaining speaker drivers of the first plurality of substantially similar speaker drivers being disposed farther from the first lateral side of the front panel and closer to a second lateral side of the front panel.

The loudspeaker of some embodiments further includes a second plurality of the substantially similar speaker drivers also arranged in an arcuate arrangement. The arcuate arrangement of the second plurality of the substantially similar speaker drivers in some embodiments places a central speaker driver of the second plurality of the substantially similar speaker drivers equally proximate to the first lateral side of the front panel as the central speaker driver of the first plurality of substantially similar speaker drivers, with each successive speaker driver of the remaining speaker drivers of the second plurality of substantially similar speaker drivers being disposed farther from the first lateral side of the front panel and closer to a second lateral side of the front panel. In some embodiments, the first plurality and the second plurality of the substantially similar speaker drivers together form a part of a sinusoidal array of the substantially similar speaker drivers.

The time alignment of the sound signal at the listening position in some embodiments includes an interval gap selected to provide an ongoing kick in acoustic sound as the sound is received at the listening position. The first plurality of substantially similar speaker drivers in some embodiments is driven by a plurality of individual amplifiers with incorporated time delays to provide the ongoing kick in acoustic sound at the listening position.

The time alignment of the sound signal produced by each of the first plurality of substantially similar speaker drivers in some embodiments is a substantially simultaneous time alignment.

The loudspeaker of some embodiments further includes one or more additional speaker drivers having a larger size and deeper cone. The additional one or more additional speaker drivers in some embodiments is disposed on the front panel within an ellipse defined by the arcuate arrangement of the first plurality of substantially similar speaker drivers such that a travel path between each of the first plurality of substantially similar speaker drivers to the listening position and a travel path of the one or more additional speaker drivers to the listening position is substantially equal.

The speaker drivers of the first plurality of substantially similar speaker drivers in some embodiments are tweeters, super tweeters, or midrange drivers. The loudspeaker of some embodiments also includes an additional speaker driver such as a midrange driver, a midbass driver, a bass driver, a woofer, or a subwoofer.

The loudspeaker in some embodiments is a near-field monitor, wherein the first plurality of the substantially similar speaker drivers is disposed along the arcuate arrangement at a right side of the near-field monitor, and wherein a second plurality of the substantially similar speaker drivers is disposed in an arcuate arrangement at a left side of the near-field monitor. The near-field monitor of some embodiments further includes additional speaker drivers on either side of the near-field monitor.

The first plurality of substantially similar speaker drivers in some embodiments is configured to transmit audio signals of a lower frequency range than a single instance of the substantially similar speaker driver would normally be tasked to reproduce according to traditional loudspeaker design.

Embodiments of the invention provide a sound transducing device adapted to receive an electronic signal and to transduce the electronic signal into an audible sound signal. The sound transducing device includes a front panel, a first plurality of substantially similar sound transducers arranged in an arcuate arrangement proximate a first side of the front panel, and a second plurality of the substantially similar sound transducers arranged in a mirrored arcuate arrangement proximate an opposite side of the front panel. The sound transducing device in some embodiments is incorporated into a movable seating device having a listening position corresponding to a head of a user of the seating device, wherein the sound transducing device is incorporated into the seating device in a manner that ensures that the sound transducing device maintains a fixed relative position and orientation with respect to the listening position.

FIG. 1 illustrates a pair of exemplary loudspeakers 10, a left speaker 12 and a right speaker 14. The left speaker 12 is generally placed forward of and to the listener's left when facing the loudspeakers 10, and the right speaker 14 is generally placed forward of and to the listener's right when facing the loudspeakers 10. Each loudspeaker 10 includes a cabinet or enclosure encompassing and defining an interior volume, which interior volume in some embodiments is internally compartmentalized or in other embodiments is contiguous, and portions of which interior volume in some embodiments are made open to a rear surface of one or more speaker drivers, as is known in the loudspeaker design art. The interior volume in some embodiments is tuned in conjunction with one or more speaker drivers of the loudspeaker 10, as is known in the art. The enclosure defining the interior volume in some embodiments is formed of one or more generally planar panels, including a front panel 16, as is known in the art. Portions or all of the interior volume may optionally be vented or ported to an exterior of the enclosure using one or more ports 18, as is also known in the art.

The front panel 16 serves to provide a surface on which the speaker drivers of the loudspeaker 10 in some embodiments are mounted, and one of the panels of the enclosure may serve to have an electrical connection mounted thereon (not shown, and most typically some panel other than the front panel 16) for connecting the loudspeaker 10 to an amplifier. Internally, the loudspeaker 10 may have one or more crossover networks and electrical wiring extending between the electrical connection and the various speaker drivers, as is known in the art.

The illustrated loudspeakers 10 each have a single woofer 20 (an example of a speaker driver), and a single midrange driver 22. The illustrated loudspeakers also each have five matched tweeters 24. The tweeters 24 in this example are matched or otherwise substantially similar, in that they generally have functionally similar operating characteristics. In certain embodiments, all of the tweeters 24 are of a single manufacturer and make, although in other embodiments, tweeters 24 may be used from different manufacturers and may still have the same functional characteristics. The tweeters 24 in some embodiments are any desirable type of tweeter, such as cone tweeters, dome tweeters, bullet tweeters, ribbon tweeters, horn tweeters, etc.

The tweeters 24 of each speaker are disposed, in this example, in a generally vertical arcuate arrangement having symmetry around a horizontal line of symmetry passing through the centermost tweeter. The centermost tweeter 24 is the tweeter 24 most proximate an outer edge 26 of the front panel 16 of each loudspeaker 10 (thus the left edge of the left speaker 12 and the right edge of the right speaker 14), and each of the tweeters 24 that is immediately adjacent the centermost tweeter 24 is somewhat more proximate an inner edge 28 of the front panel 16 of each loudspeaker 10 (thus the right edge of the left speaker 12 and the left edge of the right speaker 14). The topmost and bottommost tweeters 24 are even more proximate the inner edge 28 of the front panel 16 of each loudspeaker 10. Accordingly, the tweeters 24 form a five-tweeter array on the front panel 16 of each loudspeaker, in which the array is disposed on an arc on a plane parallel to the plane of the front panel 16 of each loudspeaker 10. In some embodiments, the arc is a circular arc (i.e., an arc forming a segment of a circle), and in other embodiments, the arc is an arc differing from a circular arc.

The arcuate arrangement of the tweeters 24 allows for controlling a desired sound effect at a listening position for the loudspeakers 10. In one example, the desired sound effect is time aligning the sounds generated by each of the various tweeters 24 such that sounds produced substantially simultaneously at each of the tweeters 24 arrives at the listening position substantially simultaneously, thereby generating constructive interference among the individual sound waves generated by each of the individual tweeters 24. This effect is achieved in some embodiments by having the arc on which the tweeters 24 are disposed selected to cause a distance between the listening position and each tweeter 24 be identical. In this example, the ideal listening position would be at a vertical height substantially equal to a vertical height of the central tweeter 24, which is also at the same vertical height of the midrange driver 22.

At this ideal listening position, the vertical distance between the centermost tweeter 24 and the listening position is zero, and the horizontal distance between the centermost tweeter 24 and the listening position is some value defined by the spacing of the loudspeakers 10 and the distance in front of the loudspeakers at which the listening position is located. The two immediately adjacent tweeters 24 have a non-zero vertical distance between them and the listening position. If these tweeters 24 were positioned horizontally at the same position as the centermost tweeter 24, the sound produced by the immediately adjacent tweeters 24 would arrive slightly later at the listening position, leading to destructive interference between the various tweeters 24. To prevent this, the immediately adjacent tweeters 24 are located inwardly slightly, such that the distance between the listening position and the immediately adjacent tweeters 24 is the same as the distance between the listening position and the central tweeter 24.

Similarly, the uppermost and bottommost tweeters 24 are a greater vertical distance above and below, respectively, the vertical location of the listening position. Accordingly, the horizontal location of the uppermost and bottommost tweeters 24 is selected to be more toward the inner edge 28 of the front panel, thereby reducing the horizontal distance between those tweeters 24 and the listening position such that the overall distance between those tweeters 24 and the listening position is maintained to be identical to the distance between the listening position and all the other tweeters 24.

According to these principles, a loudspeaker 10 can be designed having any desired number of tweeters 24 (or, if desired, a plurality of any other type of speaker driver) disposed in a generally arcuate array. For example, the array could have three, four, five, six, seven, eight, nine, ten, or any number of tweeters 24 disposed in the array. If the number of tweeters 24 in a particular array is odd, then a single central tweeter 24 would be disposed most proximate the outer edge 26 of the front panel. If the number of tweeters 24 in a different array is even, then two central tweeters 24 would be disposed equally most proximate the outer edge 26 of the front panel.

As may be appreciated from the foregoing discussion, the tightness of the arc on which the tweeters 24 is disposed may be varied as necessary to account for a desired placement of the loudspeakers 10 (e.g., a distance between the left speaker 12 and the right speaker 14). If, for example, the loudspeakers 10 are to be placed relatively closer to each other, then the tweeters 24 would be placed on a tighter curve, as from the listening position, vertical displacement of successive tweeters 24 would result in a relatively larger required horizontal shift to maintain equal distances between tweeters 24. Conversely, if the loudspeakers 10 are to be placed more distant from each other, the tweeters 24 would be placed on a wider arc, with less horizontal displacement between immediately adjacent tweeters 24. Accordingly, the specific disposition of tweeters 24 shown in FIG. 1 is intended to be illustrative only, and the exact curve of the arc of the tweeters 24 will vary depending on the specific desired application.

According to one idealized speaker placement, the arc of the tweeters 24 of the left speaker 12 and the arc of the tweeters 24 of the right speaker 14 are both circular arcs. In fact, if the speakers are correctly placed, the arc of the tweeters 24 of the left speaker 12 and the arc of the tweeters of the right speaker 14 are both segments of the same circle, in which the circle is the right planar segment of a cone swept from a point defined as the listening position.

In some embodiments, the midrange driver 22 is placed so as to be within the arc defined by the tweeters 24, as illustrated in FIG. 1. As is known in the art, larger speaker drivers typically have larger and deeper moving elements, such that sounds leaving the larger speaker drivers (e.g., the midrange driver 22 of FIG. 1) that are formed at the same time as sounds leaving the smaller speaker drivers (e.g., the tweeters 24 of FIG. 1) are not necessarily naturally time-aligned with each other. This may lead to unwanted interference effects, particularly at or near crossover frequencies where both types of drivers are simultaneously producing audible sound.

In the embodiment of FIG. 1, the placement of the midrange driver 22 within the arc of the tweeters 24 may assist in time aligning sounds reproduced by the various speaker drivers. Because the midrange driver 22 is horizontally placed more toward the inner edge 28 of the front panel 16, it will be horizontally closer to the listening position. Accordingly, this horizontal difference in placement may serve to offset the fact that the moving element of the midrange driver 22 (e.g., the paper cone, etc.) is deeper, and thus on average slightly farther away from the listening position in a front-to-back perspective. Accordingly, this placement may serve to further time-align sounds reproduced by not only the tweeters 24 but also by the midrange driver 22 at the listening position.

Figure 2:
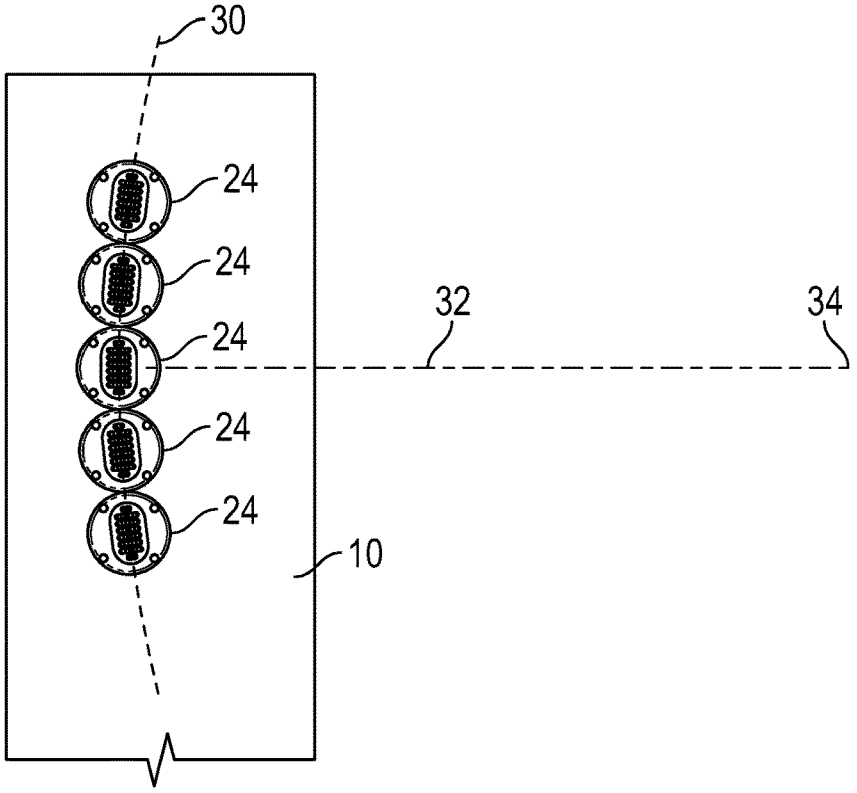
FIG. 2 shows a front plan view of a portion of a representative loudspeaker.

FIG. 2 illustrates another loudspeaker 10 with placement of tweeters 24 on a circular arc 30 defined by the sweep of a radius 32 around a central point 34. The loudspeaker 10 of FIG. 2 represents a left speaker 12, and the right speaker 14 (not shown) would be placed such that its tweeters 24 would fall on a corresponding arc also swept by the radius 32 if continued 180° from the arc 30 of FIG. 2. The listening position lies on a line extending perpendicular to the circle swept by the radius 32 at the central point 34. As may be appreciated, any listening position falling on this line extending from the central point 34 will be substantially equidistant from any speaker driver (tweeter 24) falling on the circular arc 30.

In FIG. 2, the tweeters 24 are ribbon tweeters. In other embodiments, such as illustrated in FIG. 1 and discussed previously, the tweeters 24 may be any other type of tweeter.

Figure 3:
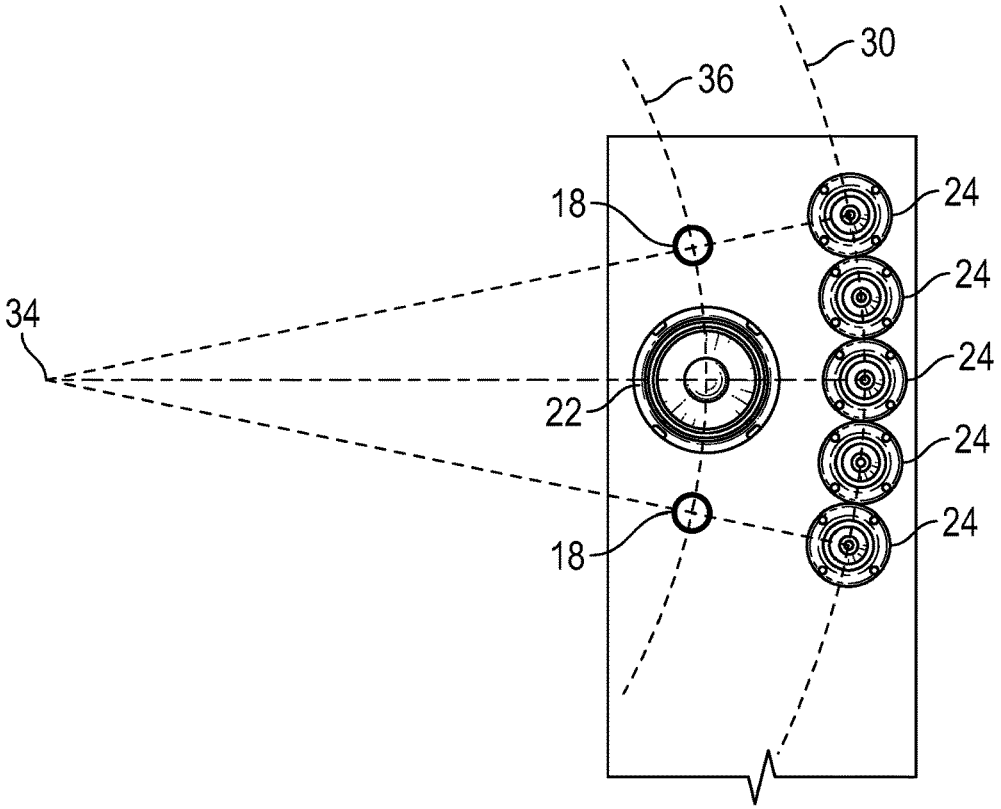
FIG. 3 shows a front plan view of a portion of a representative loudspeaker.

FIG. 3 illustrates another loudspeaker 10, this one having the tweeters 24 falling on the circular arc 30 discussed with respect to the embodiment of FIG. 2, but with the midrange driver 22 being present along with ports 18. In this embodiment, the ports 18 are also placed on a secondary circular arc 36 that is also swept relative to the central point 34, but on a shorter radius, such that the secondary circular arc 36 passes through the center of the midrange driver 22. Accordingly, the ports 18 located above and below the midrange driver 22 are not centered on a vertical line passing through the midrange driver 22, but are instead shifted toward the inner edge 28 of the loudspeaker 10. In this example, the midrange driver 22 and the tweeters 24 are only substantially perfectly equidistant from a single listening position based on distance effects between the relative depths of the midrange driver 22 and the tweeters 24. In certain embodiments, the tweeters 24 and/or the midrange driver 22 are mounted at a position elevated forward from the surface of the front panel 16 so as to modify the effective ideal listening position.

Figure 4:
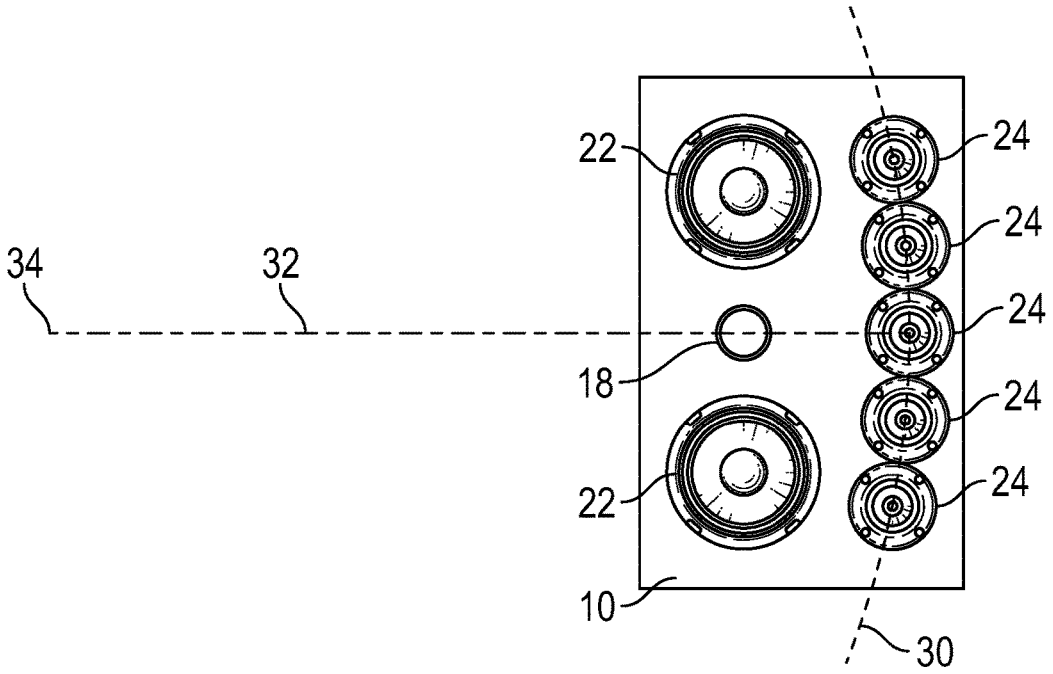
FIG. 4 shows a front plan view of a representative loudspeaker.

FIG. 4 illustrates another loudspeaker 10, this embodiment representing a studio monitor speaker or bookshelf speaker design. In this design, the loudspeaker 10 continues to include five tweeters 24, but also includes two midrange drivers 22, which could also be considered two woofers 20, depending on the frequencies to which the larger drivers could be tasked. The embodiment of FIG. 4 illustrates the wide variety of loudspeaker designs into which the features provided by the arcuate arrangement of drivers could be incorporated.

While one particular auditory effect, namely time alignment of sounds arriving at a listening position, has been discussed relative to FIGS. 1-4, it is possible to utilize arcuate arrangements of speaker drivers to achieve a different auditory effect. In particular, it may be desirable to have sound from multiple individual speaker drivers arrive at a listening position with slightly offset times to provide an interval gap selected to provide an ongoing kick in acoustic sound as the sound is received at the listening position. By way of a simplified example only, if the left speaker 12 of FIG. 1 were to be used instead as a right speaker, and the right speaker 14 of FIG. 1 were to be used instead as a left speaker, then the arcuate arrangement of tweeters 24 would, instead of time aligning sound at a listening position, create an interval gap in the time of arrival of sound from each of the tweeters at the listening position, thereby potentially creating the ongoing kick in acoustic sound received at the listening position.

Alternatively or additionally, the interval gap selected to provide an ongoing kick in acoustic sound as the sound is received at the listening position in some embodiments is provided by or enhanced by circuitry included with or associated with the loudspeakers 10 that artificially adds time delay to the sounds sent to individual tweeters 24 of the plurality of tweeters 24. Examples of such circuitry include digital signal processing (DSP) circuitry incorporated into or associated with the loudspeakers, as well as individual amplifiers associated with each tweeter 24 and adapted to insert any desired or necessary time delays.

Figure 5:
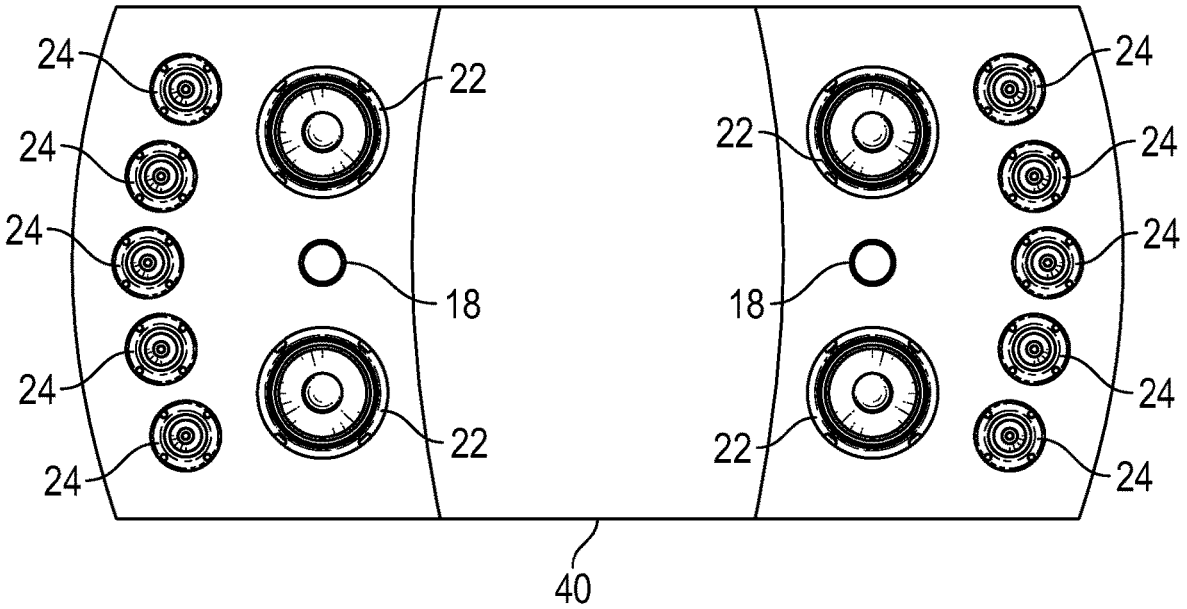
FIG. 5 shows a front plan view of a representative near-field monitor.

While exemplary embodiments of the loudspeakers 10 have been discussed with respect to FIGS. 1-4, other embodiments are possible, including embodiments having multiple pluralities of speaker drivers arranged in multiple arcuate arrangements. For example, FIG. 5 illustrates a near-field monitor 40. The near-field monitor in some embodiments is adapted to provide a user with a listening experience in a confined space or environment. For example, in some embodiments the near-field monitor 40 is mounted to an individual listening chair. The listening chair is adapted to provide a fixed listening position (e.g., where the user's head is anticipated to be), and the near-field monitor 40 in some embodiments is mounted to direct the sound to the listening position. The near-field monitor in some embodiments is mounted so as to move in conjunction with changes in the listening position. Thus, for example, if the listening chair were to be reclined, the near-field monitor 40 could move up and rotate as the chair reclines, such that the position and angle of the near-field monitor 40 relative to the listening position remains fixed. The near-field monitor could be used, for example, in theater seats having individual sound systems, in arcade-style game consoles, in home-theater seats, and the like.

As the near-field monitor 40 is formed of a unitary body, the near-field monitor has a first plurality of tweeters 24 arranged in a first arcuate arrangement (e.g., the five tweeters along the left side of the near-field monitor 40). Similarly, the near-field monitor also has a second plurality of tweeters 24 arranged in a second arcuate arrangement (e.g., the five tweeters along the right side of the near-field monitor 40). Accordingly, the near-field monitor 40 is one example of a loudspeaker having multiple pluralities of speaker drivers arranged in multiple arcuate arrangements.

Figure 6:
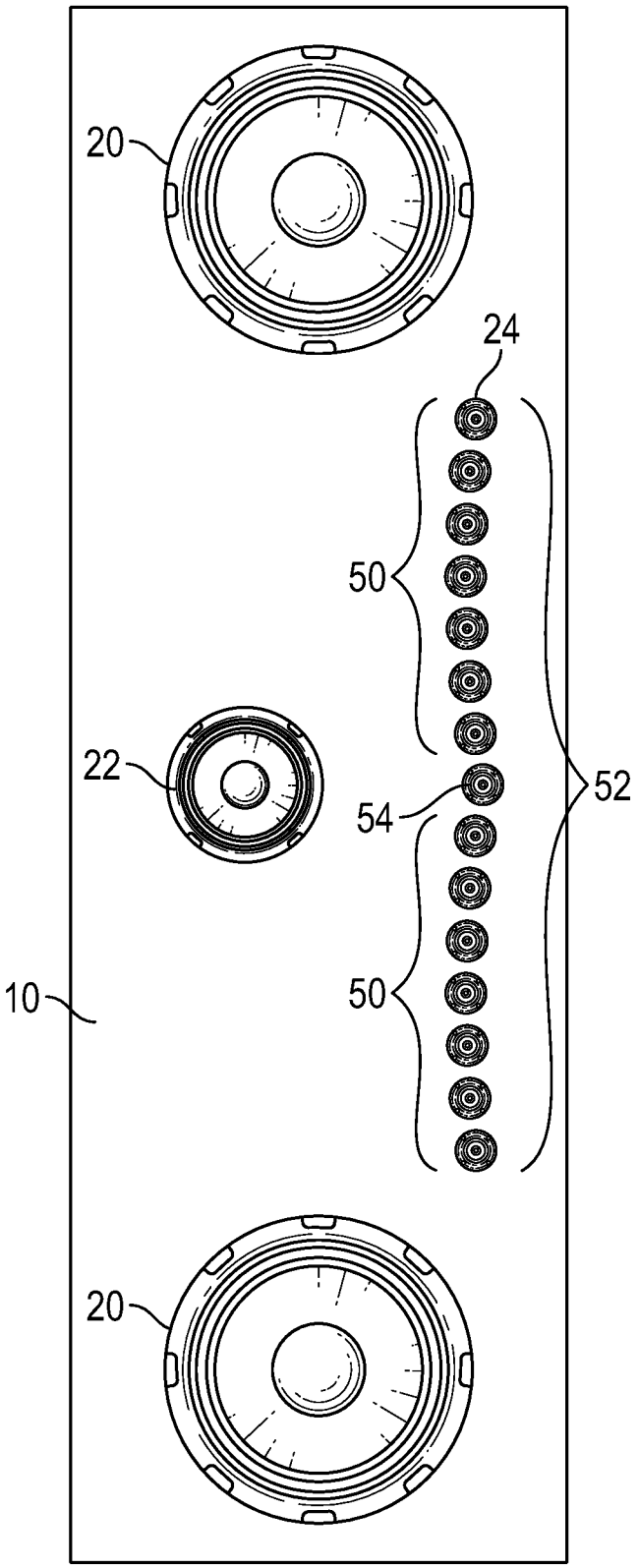
FIG. 6 shows a front plan view of a representative loudspeaker.
Figure 7:
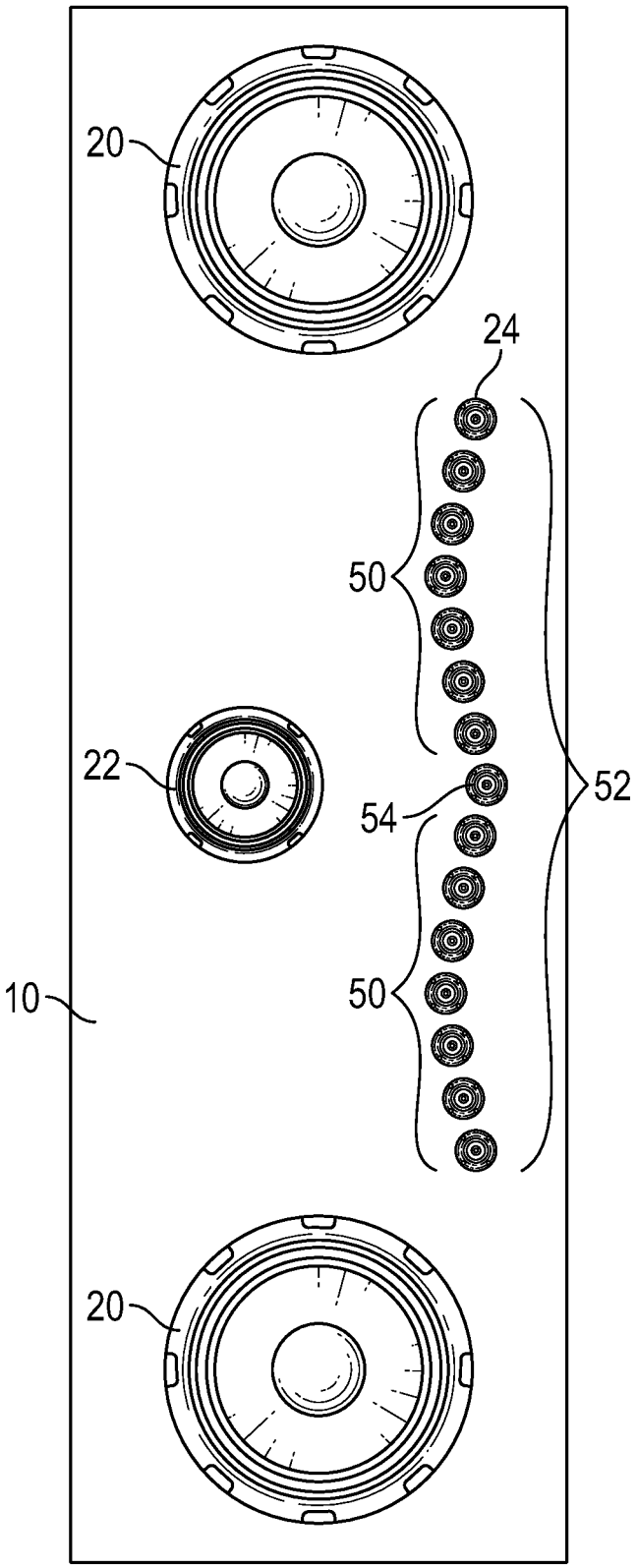
FIG. 7 shows a front plan view of a representative loudspeaker.
Figure 8:
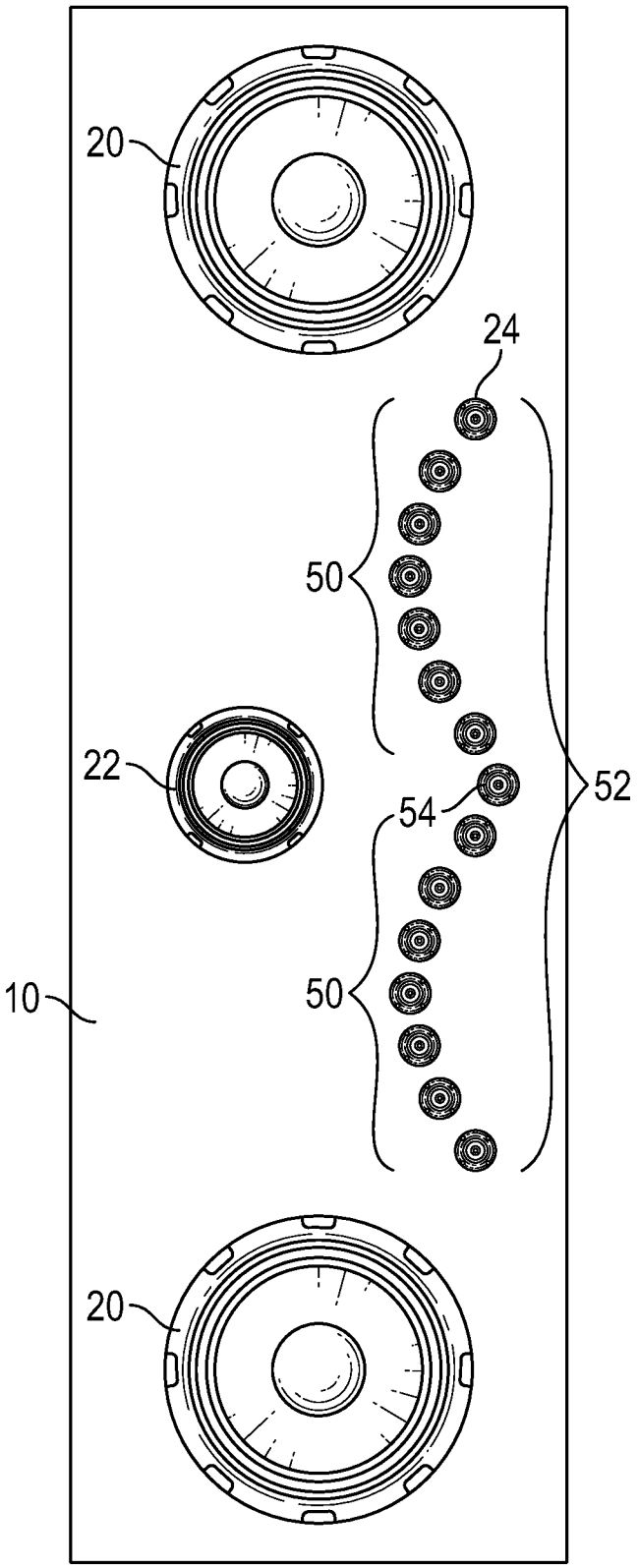
FIG. 8 shows a front plan view of a representative loudspeaker.

Other examples of a loudspeaker 10 having multiple pluralities of speaker drivers arranged in multiple arcuate arrangements is shown in FIGS. 6-8. In these embodiments, the loudspeaker 10 has multiple pluralities of tweeters 24 arranged in pairs of arcuate arrangements 50, thereby forming a generally sinusoidal arrangement 52 of tweeters 24. As may be seen by comparing the differences among the loudspeakers 10 of FIGS. 6-8, the curvature of the arcuate arrangements 50 and therefore the sinusoidal arrangement 52 of tweeters 24 may be varied between embodiments. In the embodiments of FIGS. 6-8, the sinusoidal arrangement 52 is not strictly sinusoidal, but rather a joining of two circular arcuate arrangements 50 into a quasi-sinusoidal arrangement. In other embodiments, the sinusoidal arrangement is more purely sinusoidal, thereby causing the arcuate arrangement portions of the sinusoidal arrangement 50 to not form perfectly circular arcs.

The loudspeakers 10 of FIGS. 6-8 include two woofers 20 and a midrange driver 22. As may be seen by comparison of the arcuate arrangements 50 to the sinusoidal arrangement 52, the sinusoidal arrangement 52 may include more tweeters 24 than the combination of the two sinusoidal arrangements 50. Specifically, in the embodiments of FIGS. 6-8, the sinusoidal arrangement 52 includes a central tweeter 54 that does not form a part of either the upper arcuate arrangement 50 or the lower arcuate arrangement 50. In some embodiments, the central tweeter 54 is tasked with reproducing a highest range of frequencies, while the arcuate arrangements 50 of tweeters 24 are tasked with collectively reproducing a lower range of frequencies, as discussed in U.S. Pat. No. 9,247,339. The arcuate arrangements 50 may thus have a lower moving mass than would a single larger speaker driver, achieving responsiveness benefits while also providing for one or more of the effects discussed herein (time alignment or an ongoing kick in acoustic sound).

In some embodiments having multiple arcuate arrangements 50 of speaker drivers as illustrated in FIGS. 6-8, the speaker drivers in the arcuate arrangements 50 are located on angled front panels 16 (in other words, with the top of the front panel 16 not directly vertically above the bottom of the front panel 16) so as to aim the respective best listening position of the respective arcuate arrangements 50 so as to coincide at a single listening position. Similarly, in certain embodiments having a single arcuate arrangement of speaker drivers as illustrated in FIGS. 1-4, the front panel 16 is angled so as to cause the listening position to fall above or below a horizontal plane passing through the center of the arcuate arrangement. Similarly, the loudspeaker 10 itself may simply be tilted forward or backward to aim the loudspeaker 10 to a desired listening position (e.g., height), in a manner similar to that discussed with respect to the near-field monitor 40 of FIG. 5. Accordingly, embodiments of the invention provide multiple mechanisms to best achieve desired sound effects at multiple listening positions.

Figure 9:
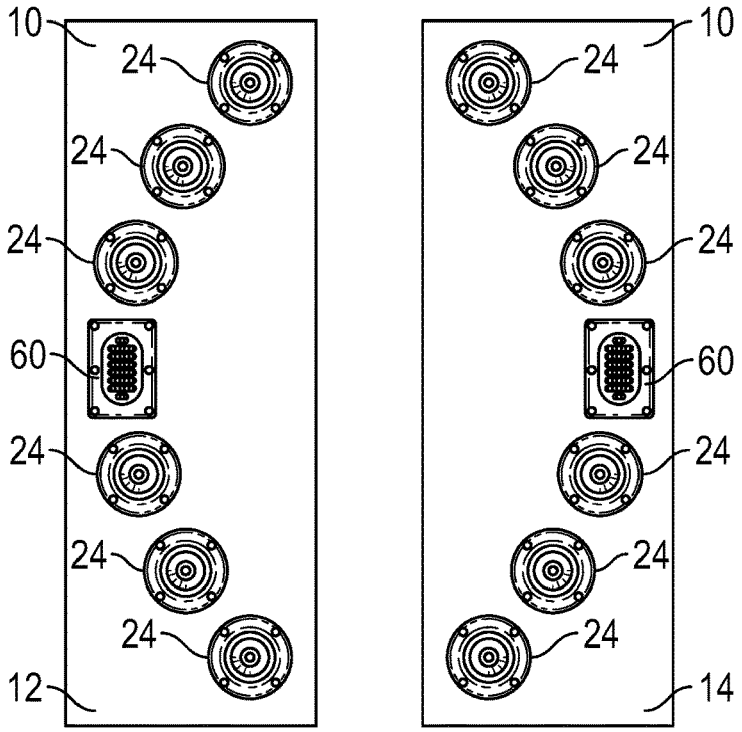
FIG. 9 shows a front plan view of a pair of representative loudspeakers.

FIG. 9 shows another representative pair of loudspeakers 10, the left speaker 12 and the right speaker 14. In this embodiment, the speaker drivers in the arcuate arrangement include six substantially similar drivers, which in some embodiments are tweeters 24, as well as a centralized higher-frequency-dedicated speaker driver, which in some embodiments is a higher frequency type tweeter, such as a ribbon tweeter 60. In some embodiments, as discussed above, the lower-frequency speaker drivers, arranged in the arcuate arrangement, collectively serve as discussed in U.S. Pat. No. 9,247,339 to reproduce lower-frequency sounds, including sounds having a lower frequency than the speaker drivers might normally be tasked to reproduce according to traditional loudspeaker design principles. The higher-frequency speaker driver can then reproduce higher frequencies.

Figure 10:
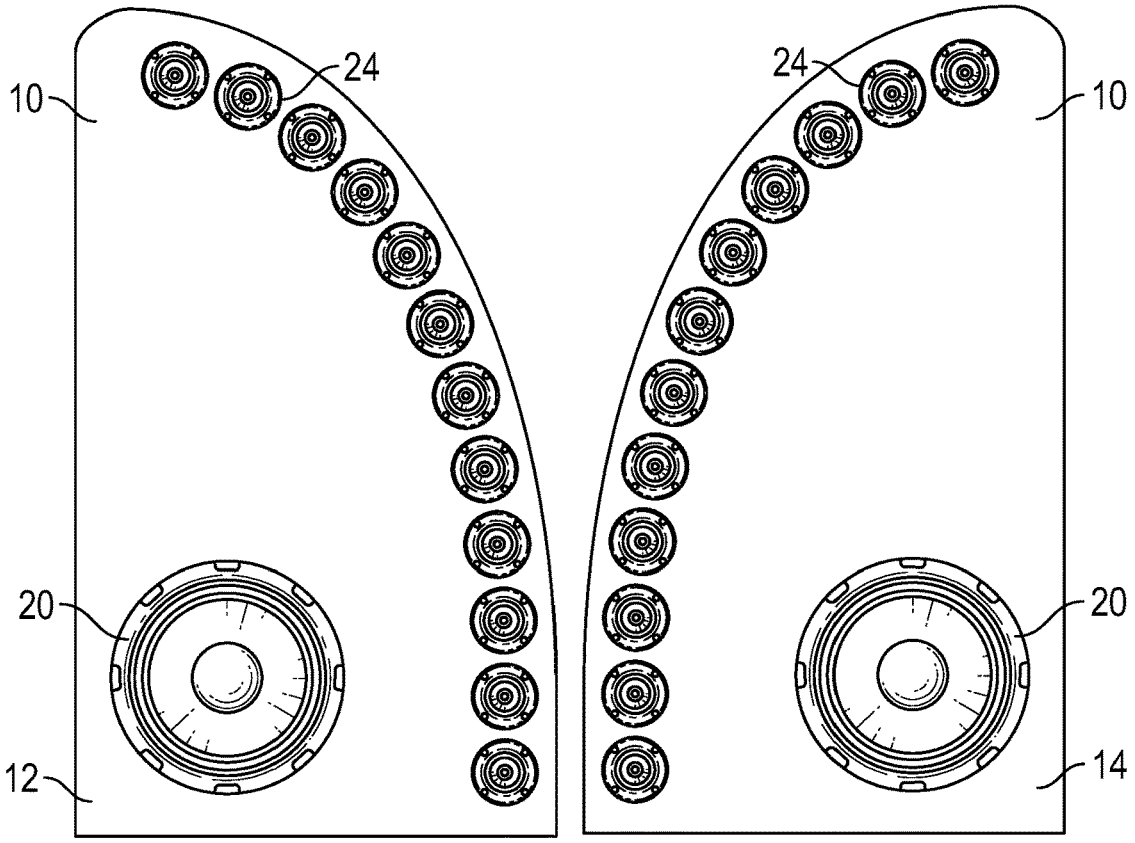
FIG. 10 shows a front plan view of a pair of representative loudspeakers.
Figure 11:
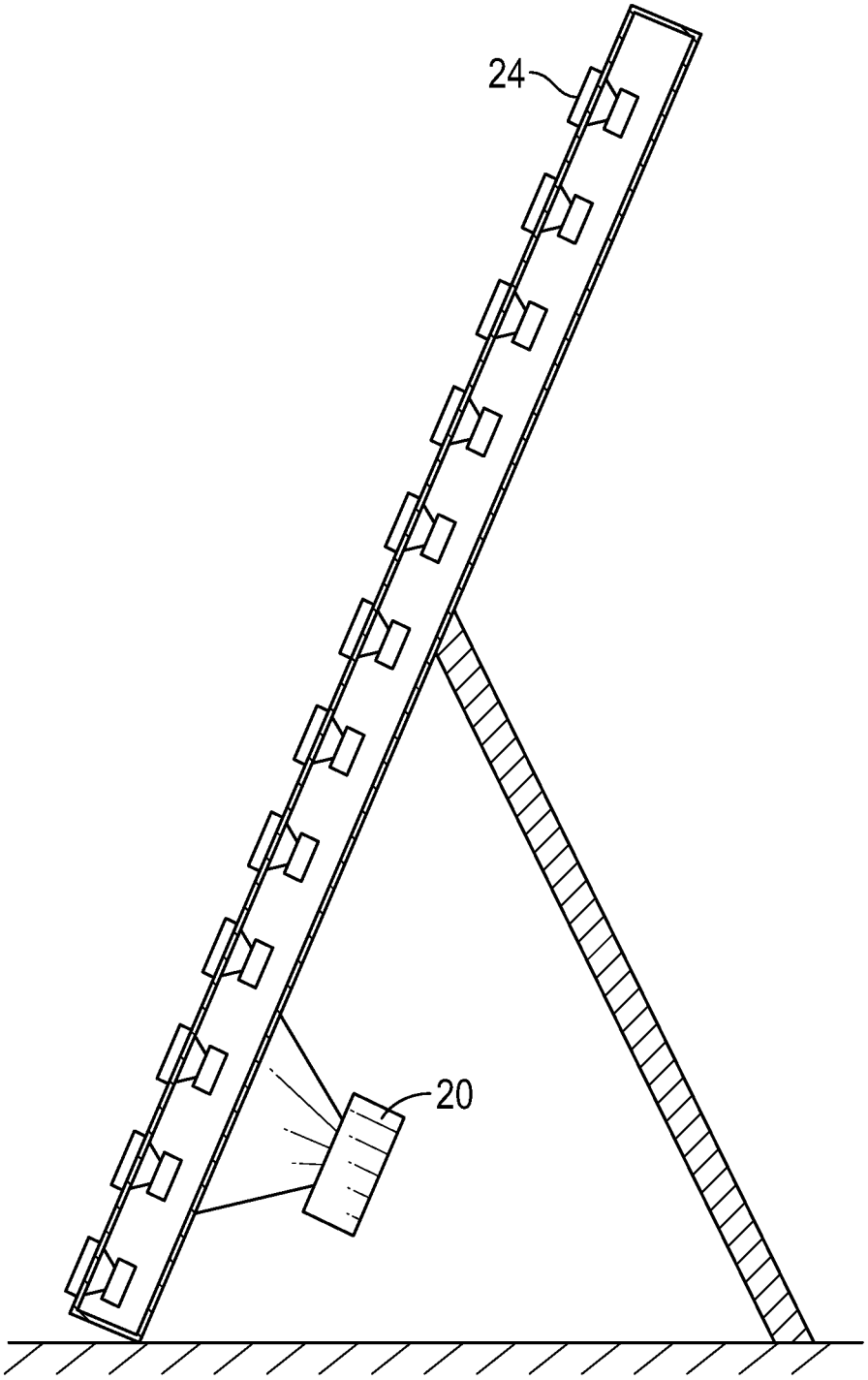
FIG. 11 shows a side view of one of the loudspeakers of FIG. 10.

FIGS. 10 and 11 show another representative pair of loudspeakers 10, with FIG. 10 showing front plan views of the left speaker 12 and the right speaker 14 and with FIG. 11 showing a side plan view of one of the loudspeakers 10. As shown in FIG. 11, the front panel 16 of this embodiment is disposed in an angled configuration, and in some embodiments is an open-back loudspeaker (shown in FIG. 11), or a closed-back loudspeaker (not shown). This embodiment of loudspeaker 10 may be particularly suited for achieving a sound effect at the listening position of providing a progressive kick in sound received at the listening position. In this embodiment, the arcuate arrangement of tweeters 24 is disposed other than equidistant from the listening position, and in fact in use the lower-most tweeters 24 are closest to the listener, and the effects of, first, subsequent tweeters 24 being tilted back and, second, arcing outward away from the listener or listening position both serve to cause sounds received from each subsequent vertically higher tweeter 24 to arrive slightly later, resulting in enhancement of the progressive kick in sound.

The present invention may be embodied in other specific forms without departing from its spirit or essential characteristics. The described embodiments are to be considered in all respects only as illustrative and not restrictive. The scope of the invention is, therefore, indicated by the appended claims, rather than by the foregoing description. All changes which come within the meaning and range of equivalency of the claims are to be embraced within their scope.

What is claimed and desired to be secured by Letters Patent is:

1. A loudspeaker comprising:

a speaker cabinet having a front panel defining a substantially flat planar front surface of the loudspeaker;

a first plurality of substantially similar higher-frequency speaker drivers disposed on the front panel, the first plurality of substantially similar speaker drivers being disposed in a generally vertical arcuate arrangement and having symmetry around a horizontal line of symmetry on the substantially flat planar front surface of the front panel, thereby being adapted to modify time alignment of a sound signal produced by each of the first plurality of substantially similar speaker drivers at a listening position;

at least one lower-frequency speaker driver disposed on the front panel;

an electrical connection adapted to permit connection of the loudspeaker to an amplifier; and a crossover network electrically connected between the electrical connection and the first plurality of substantially similar higher-frequency speaker drivers and the at least one lower-frequency speaker driver and configured to direct higher-frequency audio signals to the first plurality of substantially similar higher-frequency speaker drivers and to direct lower-frequency audio signals to the at least one lower-frequency speaker driver.

2. The loudspeaker of claim 1, wherein the first plurality of substantially similar speaker drivers is mounted in a single plane substantially parallel to a plane of the front panel of the speaker cabinet.

3. The loudspeaker of claim 2, wherein the first plurality of substantially similar speaker drivers each has a driver axis, and wherein the driver axis of each of the first plurality of substantially similar speaker drivers is substantially perpendicular to the plane of the front panel of the speaker cabinet.

4. The loudspeaker of claim 2, wherein the first plurality of substantially similar speaker drivers each has a driver axis, and wherein the driver axis of each of the first plurality of substantially similar speaker drivers is within 10° of perpendicular to the plane of the front panel of the speaker cabinet.

5. The loudspeaker of claim 1, wherein a travel path distance between each of the first plurality of substantially similar speaker drivers and the listening position is substantially identical to a travel path distance of all the other speaker drivers of the first plurality of substantially similar speaker drivers.

6. The loudspeaker of claim 1, wherein the arcuate arrangement places a central speaker driver of the first plurality of substantially similar speaker drivers most proximate to a first lateral side of the front panel, with each successive speaker driver of the remaining speaker drivers of the first plurality of substantially similar speaker drivers being disposed farther from the first lateral side of the front panel and closer to a second lateral side of the front panel.

7. The loudspeaker of claim 6, further comprising a second plurality of the substantially similar speaker drivers also arranged in a generally vertical arcuate arrangement, and wherein the arcuate arrangement of the second plurality of the substantially similar speaker drivers places a central speaker driver of the second plurality of the substantially similar speaker drivers equally proximate to the first lateral side of the front panel as the central speaker driver of the first plurality of substantially similar speaker drivers, with each successive speaker driver of the remaining speaker drivers of the second plurality of substantially similar speaker drivers being disposed farther from the first lateral side of the front panel and closer to a second lateral side of the front panel.

8. The loudspeaker of claim 7, wherein the first plurality and the second plurality of the substantially similar speaker drivers together form a part of a sinusoidal array of the substantially similar speaker drivers.

9. The loudspeaker of claim 8, wherein the time alignment of the sound signal at the listening position comprises an interval gap selected to provide an ongoing kick in acoustic sound as the sound is received at the listening position.

10. The loudspeaker of claim 1, wherein the time alignment of the sound signal produced by each of the first plurality of substantially similar speaker drivers comprises an interval gap selected to provide an ongoing kick in acoustic sound as the sound is received at the listening position.

11. The loudspeaker of claim 10, wherein the first plurality of substantially similar speaker drivers is driven by a plurality of individual amplifiers with incorporated time delays to provide the ongoing kick in acoustic sound at the listening position.

12. The loudspeaker of claim 1, wherein the time alignment of the sound signal produced by each of the first plurality of substantially similar speaker drivers is a substantially simultaneous time alignment.

13. The loudspeaker of claim 12, wherein the loudspeaker further comprises one or more additional speaker drivers having a larger size and deeper cone, and wherein the additional one or more additional speaker drivers is disposed on the front panel within an ellipse defined by the arcuate arrangement of the first plurality of substantially similar speaker drivers such that a travel path between each of the first plurality of substantially similar speaker drivers to the listening position and a travel path of the one or more additional speaker drivers to the listening position is substantially equal.

14. The loudspeaker of claim 1, wherein the speaker drivers are selected from the group consisting of tweeters, super tweeters, and midrange drivers.

15. The loudspeaker of claim 1, wherein the speaker drivers are tweeters disposed on an upper portion of the front panel, the loudspeaker further comprising:

a midrange driver disposed on the upper portion of the front panel within an ellipse defined by the generally vertical arcuate arrangement; and a woofer disposed on a lower portion of the front panel below the generally vertical arcuate arrangement of tweeters and below the midrange driver.

16. The loudspeaker of claim 1, wherein the loudspeaker is a near-field monitor, wherein the first plurality of the substantially similar speaker drivers is disposed along the arcuate arrangement at a right side of the near-field monitor, and wherein a second plurality of the substantially similar speaker drivers is disposed in a generally vertical arcuate arrangement at a left side of the near-field monitor.

17. The loudspeaker of claim 16, wherein the near-field monitor further comprises additional speaker drivers on either side of the near-field monitor.

18. The loudspeaker of claim 1, wherein the first plurality of substantially similar speaker drivers is configured to transmit audio signals of a lower frequency range than a single instance of the substantially similar speaker driver would traditionally be tasked to reproduce.

19. A sound transducing device adapted to receive an electronic signal and to transduce the electronic signal into an audible sound signal, the sound transducing device comprising:

a front panel defining a substantially flat planar front surface;

a first plurality of substantially similar higher-frequency sound transducers arranged in a generally vertical arcuate arrangement and having symmetry around a horizontal line of symmetry on the substantially flat planar front surface and proximate a first side of the front panel;

a second plurality of the substantially similar higher-frequency sound transducers arranged in a mirrored generally vertical arcuate arrangement on the substantially flat planar front surface and proximate an opposite side of the front panel;

at least one lower-frequency speaker driver disposed on the front panel within one or more ellipses defined by the generally vertical arcuate arrangement of the first plurality of the substantially similar higher-frequency sound transducers and the mirrored generally vertical arcuate arrangement of the second plurality of the substantially similar higher-frequency sound transducers;

an electrical connection adapted to permit connection of the loudspeaker to an amplifier; and a crossover network electrically connected between the electrical connection and the first plurality of substantially similar higher-frequency speaker drivers and the at least one lower-frequency speaker driver and configured to direct higher-frequency audio signals to the first and second pluralities of the substantially similar higher-frequency speaker drivers and to direct lower-frequency audio signals to the at least one lower-frequency speaker driver.

20. The sound transducing device as recited in claim 19, wherein the sound transducing device is incorporated into a movable seating device having a listening position corresponding to a head of a user of the seating device, wherein the sound transducing device is incorporated into the seating device in a manner that ensures that the sound transducing device maintains a fixed relative position and orientation with respect to the listening position.

* * * * *